United States Patent [19]

Schiffer

[11] 4,226,598

[45] Oct. 7, 1980

[54] METHOD AND APPARATUS FOR WET TREATMENT, ESPECIALLY TREATING WITH LYE SOLUTION AND MERCERIZING, OF KNITTED TUBULAR FABRIC

[75] Inventor: Günter Schiffer, Krefeld, Fed. Rep. of Germany

[73] Assignee: Kleinewefers GmbH, Krefeld, Fed. Rep. of Germany

[21] Appl. No.: 13,806

[22] Filed: Feb. 21, 1979

[30] Foreign Application Priority Data

Feb. 21, 1978 [DE] Fed. Rep. of Germany ..... 2807312

[51] Int. Cl.[2] ..... D06M 1/02; D06B 7/10; D06B 3/34

[52] U.S. Cl. ..... 8/125; 8/151; 8/151.1; 68/113; 68/DIG. 5; 68/99

[58] Field of Search ..... 68/DIG. 1, 113, DIG. 5; 8/125, 151, 151.1

[56] References Cited

U.S. PATENT DOCUMENTS

| | | | |
|---|---|---|---|
| 3,449,060 | 6/1969 | Schenck | 8/151 |
| 4,068,501 | 1/1978 | Aronoff et al. | 68/DIG. 5 |
| 4,112,532 | 9/1978 | Catallo | 8/151 |

FOREIGN PATENT DOCUMENTS

| | | | |
|---|---|---|---|
| 2813603 | 10/1978 | Fed. Rep. of Germany | 8/125 |

*Primary Examiner*—John Kight, III
*Attorney, Agent, or Firm*—Becker & Becker, Inc.

[57] ABSTRACT

A method and apparatus for wet treatment, especially treating with lye solution and mercerizing, of knitted tubular goods. According to the method, the tube is passed through the space between adjacent rollers. A longitudinal movement is imparted to one of the two respectively straight portions of the cross section of the tube, while a transverse movement is imparted to the other straight section. The apparatus for carrying out this method is a foulard having driven rollers, at least some of which are constantly movable in an axial direction, which is transverse to the longitudinal movement of the tube, successive axially movable rollers having a progressively delayed axial movement.

10 Claims, 5 Drawing Figures

METHOD AND APPARATUS FOR WET TREATMENT, ESPECIALLY TREATING WITH LYE SOLUTION AND MERCERIZING, OF KNITTED TUBULAR FABRIC

The present invention relates to a method of wet treatment, especially treating with lye solution and mercerizing, of knitted circular or tubular fabric (tubular knitted goods), according to which the tube is passed through between two adjacent clearance areas or cleavage surfaces. The present invention also relates to an apparatus for carrying out this method.

The treating with lye solution and mercerizing of warp knit goods can be effected with the aid of a foulard using expanders, which are driven or operated counter to the movement of the goods and with the aid of which it is attempted to avoid the curling of the edge sections of the fabric layer. It has been attempted with the aid of segmented expanders to avoid the high tension in the longitudinal direction which occurs with simple expanders.

Particularly noticeable during treating with lye solution and mercerizing of tubular fabric is the drawback that on the edges of the tube edge markings result due to the fact that the fabric tensioning necessary for treating with lye solution or for mercerizing is not effected at the edges of the fabric or knitting. Especially to mercerize tubular fabric, therefore, after a temporary storage of the tube outside the lye solution, this tube is stabilized with a tube opener along with simultaneous removal of lye solution, in a manner similar to that which occurs with a knitted fabric mercerizing machine. It is also known to treat hosiery or knitted goods in a chainless mercerizing machine and, prior to the washing, to remove lye solution and prerinse on a tube opener, over a longer stretch or distance.

The known methods and apparatuses for lye solution treatment and mercerizing of knitted goods, especially of tubular knitted goods, cannot prevent a diversified lye solution treatment and mercerizing over the cross section of the knitting, which shows up as variations in color after the dyeing in the form of edge markings.

It is therefore an object of the present invention to provide a method and an apparatus with which a uniform wet treatment over the entire cross section of the tube is assured, in other words, with which a uniform action of the treatment fluid on the tube is possible.

This object, and other objects and advantages of the present invention, will appear more clearly from the following specification in connection with the accompanying drawings, in which.

Figure 1:
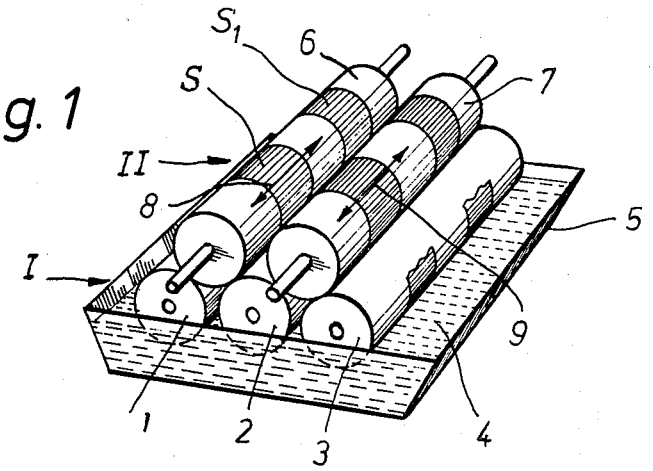
FIG. 1 is a schematic view of a portion of the rollers of a lye solution treatment part of a mercerizing apparatus.

The method of the present invention is characterized primarily in that while a longitudinal movement is imparted to one of the two respectively straight sections of the tube cross section, a transverse movement is imparted to the second straight section.

Pursuant to a further preferred embodiment of the method of the present invention, during the longitudinal movement of the tube, one of the two straight tube cross-sectional portions which are parallel to one another receives a back and forth transverse movement directed to both sides of the original vertical middle plane of the tube.

The length of the transverse movement of the one respectively straight tube cross-sectional portion relative to the second straight portion can be up to 50% of the width of the tube.

The present invention starts with the idea of laterally displacing the position of the transverse edges during the longitudinal movement of the tube, as a result of which the original edge sections become straight tube sections and vice versa. Due to the continuous lateral back and forth movement of the tube, a uniform treatment of the tubular knitted goods results to such an extent that at no point of the tube cross section a lye concentration or a particularly intensive treatment of the tube section relative to the adjacent tube sections, and thereby no edge marking, results.

The apparatus for carrying out the method according to the present invention is characterized primarily by a foulard having driven rollers which are constantly movable in an axial direction; namely, with successive rollers having a progressively delayed transverse movement relative to the longitudinal movement of the textile tube, so that, when viewed from the top of the tube, in its longitudinal direction this tube executes a snake-like movement to one or both sides of its original longitudinal central axis. With a horizontal arrangement of the rows of rollers of the foulard, only the upper rollers need be longitudinally movable.

However, the arrangement of the rollers of the foulard can also be such that the upper and lower rollers execute a corresponding oppositely directed transverse movement. This is particularly possible with a vertical arrangement of the stabilizing portion of a mercerizing unit.

Preferably, the size of the axial path of movement of the rollers is infinitely variable and, in the longitudinal movement of the tube, successive rollers can execute axial movements of different magnitude.

Pursuant to a further embodiment of the apparatus of the present invention, the axially movable rollers which are successively arranged in the longitudinal direction of the tube are grouped together with respect to time. These groups have an equal directional movement with delayed stroke, with groups having differently directed paths of movement alternating with one another in the longitudinal direction of the tube.

Referring now to the drawings in detail, the apparatus which is used has a lower row of rollers I with individual rollers 1, 2, 3, which are at least partially submerged in a washing bath with lye solution or lye bath 4 which is in a pan 5, the rollers forming, for example, the lye portion of a mercerizing apparatus. Above the gap between the rollers 1 and 2, and the rollers 2 and 3, the rollers 6, 7 of the second row of rollers II are arranged in a known manner. In this connection, the upper rollers 6, 7 contact the rollers 1, 2, 3 of the row of rollers I with selective counter pressure. The width of the rollers 1, 2, 3 and 6, 7 is selected in such a way that, if desired, a plurality of tubes S, $S_1$ to be treated can be guided over the rollers.

The upper rollers 6, 7 are movable back and forth in the direction of the double arrows 8, 9, i.e. in the transverse direction of the knitted tubes S, $S_1$. In this connection, the rollers 6, 7 can have the same transverse movement, yet, relative to one another, have a delay in time in their movement.

Figure 2:
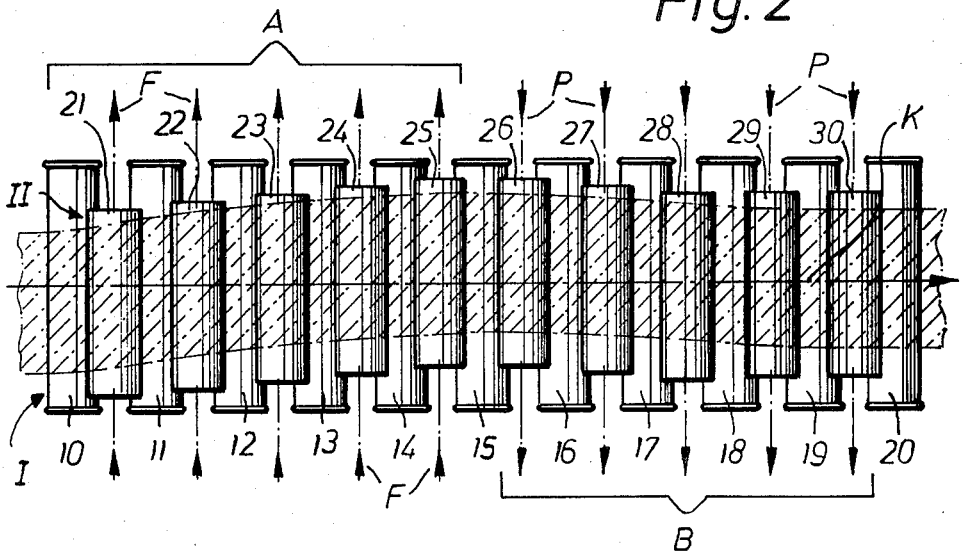
FIG. 2 is a top view of the rollers of such a lye solution treatment part.

FIG. 2 shows a larger number of upper and lower rollers than does FIG. 1. In FIG. 2 the rollers 10–20 of the lower row of rollers I are also not movable in the transverse direction, while the rollers 21–30 of the upper row II are displaced in the transverse direction. In the momentary position shown in FIG. 2, the upper rollers 21–25 belong to group A, while the upper rollers 26–30 form a second group B. In the illustrated movement position of the upper rollers, the rollers of group A carry out a movement directed in the direction of the arrows F, in the course of which, as can be clearly seen in FIG. 2, a delayed stroke movement of the successive upper rollers results. The same is true for the rollers of group B, which move in the direction of the arrows P. In the next moment, after the momentary position shown in FIG. 2, the composition of the groups has changed, and the movement of those rollers which have ended their axial stroke movement has reversed. Thus, in the next moment, the roller 25 begins a movement in the direction of the arrow P. A moment later, the roller 25 is followed by the roller 24, which in turn is followed a moment later by the roller 23, etc. In so doing, the tube S carries out a snake-like, wriggling, or twisting longitudinal movement in the direction of the arrow K.

Figure 3:
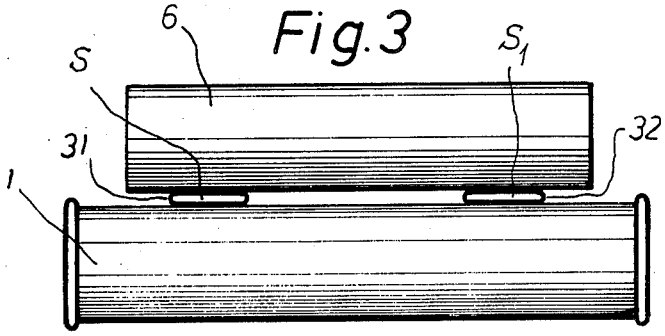
FIG. 3 is a schematic view of the manner of operation of two rollers which are associated with one another.
Figure 4:
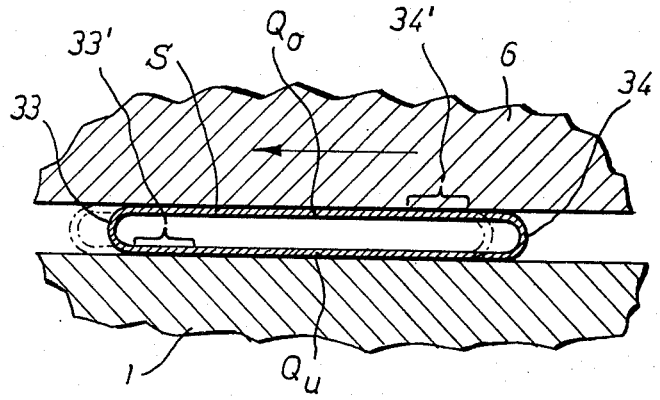
FIG. 4 shows in greater detail than does FIG. 3 the manner of operation of a transversely adjustable upper roller relative to a lower roller.

FIG. 3 shows the position of two tubes S, $S_1$ between the upper roller 6 and the lower roller 1. The distance of the outer edges 31, 32 of the tubes from the edges of the upper roller 6 has to take into account the magnitude of the axial path of the upper roller 6. FIG. 4 clearly shows the behavior of a tube S during the transverse movement of the upper roller 6 relative to the lower roller 1. During the transverse movement of the upper roller 6, the edge portion 33 moves into the position 33', and the edge portion 34 moves into the position 34', with all adjacent cross-sectional portions carrying out a corresponding movement, which can amount to up to 50% of the width of the tube.

If a plurality of rollers having the same transverse movement are provided, the axial stroke length of the upper roller 6 relative to the lower roller 1 can be comparatively small.

The upper surfaces of the rollers of the rows of rollers I and II are preferably suitably adapted to the type of knitting, that is, the upper surfaces can have a suitably coarse or smooth construction in such a way that the above described transverse movement of the respectively upper straight cross-sectional portion $Q_o$ relative to the respectively lower straight cross-sectional portion $Q_u$ is made possible.

In contrast to the above, the rollers of the lower row I can also be laterally displaceable, in which connection the lateral movement of the lower rollers is effected in an opposite direction to the lateral movement of the respectively adjacent upper rollers. Generally, however, it is sufficient, and for structural reasons is preferable, to only displace the upper rollers, as was described above.

Figure 5:
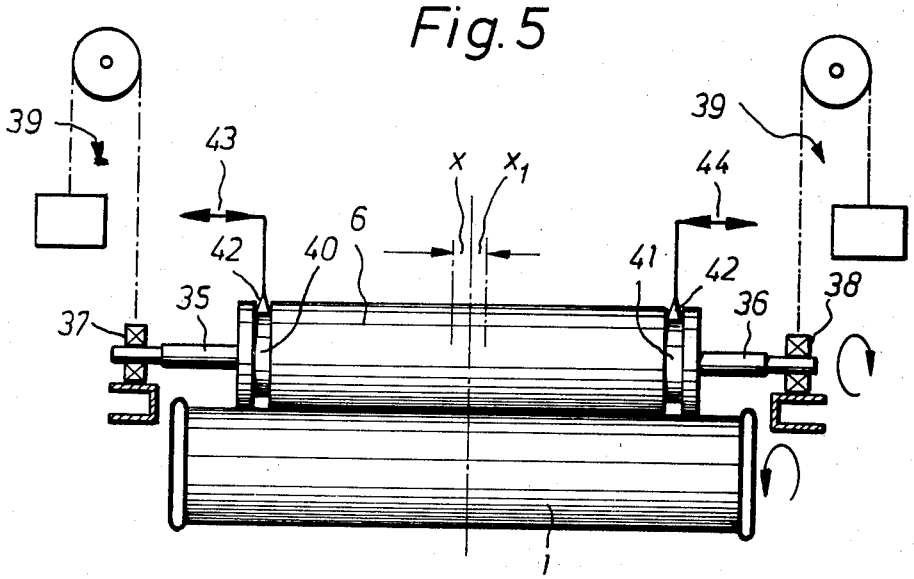
FIG. 5 is a further detail of the arrangement of an upper roller.

FIG. 5 shows a possibility for the construction of the support and arrangement of the upper rollers. The roller necks 35, 36 of the upper roller 6 are held in supports 37, 38 which can be symmetrically raised and lowered, so that the linear pressure of the roller 6 upon the lower roller 1 can be adjusted. This is symbolically shown by a weight counter balance 39 on both sides of the roller 6. Naturally, this device can also be a hydraulic counter balance.

Grooves 40, 41 are provided on the roller necks 35, 36, or on the ends of the roller 6. Parts 42 of a cam control, which is diagrammatically shown by the double arrows 43, 44, engages indirectly or directly in the grooves 40, 41. In place of the cam control, other means can also be provided, for example, pneumatic or hydraulic piston cylinder units, which impart to the rollers 6 a back and forth movement x, $x_1$ in the sense described above.

The present invention is, of course, in no way restricted to the specific disclosure of the specification or drawings, but also encompasses any modifications within the scope of the appended claims.

What I claim is:

1. A method of wet treatment, especially treating with lye solution and mercerizing, of knitted tubular goods using rollers respectively spaced from one another, which method includes the steps of:

passing said tube through the space between adjacent rollers while maintaining contact with said rollers, said tube at any given moment having two parallel straight cross sectional portions;

imparting to one of said two respectively straight portions of the tube cross section a movement directed substantially in the longitudinal direction of said tube; and imparting to the other respectively straight portion of the tube cross section a movement directed substantially in the transverse direction of said tube.

2. A method according to claim 1, which includes, during said longitudinal movement of said tube, the step of imparting to the other respectively straight portion of the tube cross section a back and forth movement directed substantially in the transverse direction of said tube and to both sides of the original longitudinal middle plane of said tube.

3. A method according to claim 2, which includes imparting a transverse movement which in a given direction has a magnitude of up to 50% of the width of said tube.

4. An apparatus for carrying out the method of claim 1, which comprises a foulard having driven rollers, at least some of which are constantly movable in an axial direction, which axial direction is substantially transverse to the longitudinal movement of said tube, successive axially movable rollers having a progressively delayed axial movement.

5. An apparatus according to claim 4, which comprises two horizontal rows of rollers arranged one above the other, the upper row of rollers being axially movable.

6. An apparatus according to claim 5, in which both of said rows of rollers are axially movable.

7. An apparatus according to claim 6, in which respective pertaining rollers of said pairs of rollers execute oppositely directed axial movements.

8. An apparatus according to claim 4, in which the magnitude of the axial movement of said rollers is continuously adjustable.

9. An apparatus according to claim 4, in which successive axially movable rollers have axial movements of different magnitudes.

10. An apparatus according to claim 9, in which, during operation, successive axially movable rollers are grouped together with respect to time, respective rollers within a given group moving in the same direction and having different magnitudes, the rollers of successive groups moving in opposite directions, so that groups of oppositely moving rollers alternate with one another in the longitudinal direction of said tube.

* * * * *